United States Patent [19]

Toyoda et al.

[11] 4,391,900

[45] Jul. 5, 1983

[54] PROCESS FOR DEVELOPMENT-PROCESSING SILVER HALIDE LIGHT-SENSITIVE MATERIAL

[75] Inventors: Takashi Toyoda; Tadao Shishido, both of Minami-ashigara; Teruaki Tsujikawa, Otsu, all of Japan

[73] Assignee: Fuji Photo Film Co., Ltd., Kanagawa, Japan

[21] Appl. No.: 339,243

[22] Filed: Jan. 13, 1982

[30] Foreign Application Priority Data

Jan. 13, 1981 [JP] Japan ..... 56-3487

[51] Int. Cl.[3] ..... G03C 5/30

[52] U.S. Cl. ..... 430/355; 430/420; 430/435; 430/438; 430/439; 430/440; 430/441; 430/442; 430/445; 430/446; 430/488

[58] Field of Search ..... 430/445, 446, 486–493, 430/419, 456, 267, 268, 355, 420, 435, 438, 439, 440, 441, 442

[56] References Cited

U.S. PATENT DOCUMENTS

| | | | |
|---|---|---|---|
| 2,403,927 | 7/1946 | Kendall et al. | 430/445 |
| 3,335,009 | 8/1967 | Rasch et al. | 430/419 |
| 3,352,678 | 11/1967 | Nishio et al. | 430/445 |
| 3,545,971 | 12/1970 | Barnes et al. | 430/355 |
| 4,132,551 | 1/1979 | Pollet et al. | 430/355 |

*Primary Examiner*—Mary F. Downey
*Attorney, Agent, or Firm*—Sughrue, Mion, Zinn, Macpeak and Seas

[57] ABSTRACT

A process for development-processing a silver halide photographic light-sensitive material is described, comprising processing with a developing solution containing 0.1 mol/liter or more of sulfite ion and at least one compound represented by formula (I)

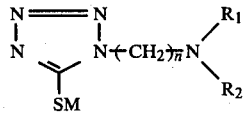

(I)

wherein n represents an integer of from 2 to 6; each of $R_1$ and $R_2$ represents hydrogen or an alkyl group having from 1 to 6 carbon atoms; and M represents hydrogen or an alkali metal atom.

According to the process, the generation of silver sludge and the formation of fog are prevented when a black-and-white photographic light-sensitive material is processed with a developing solution containing sulfates in a high concentration.

19 Claims, No Drawings

PROCESS FOR DEVELOPMENT-PROCESSING SILVER HALIDE LIGHT-SENSITIVE MATERIAL

FIELD OF THE INVENTION

This invention relates to a process for development-processing a silver halide black-and-white photographic light-sensitive material, and more particularly to a process in which silver stain and fog, which have heretofore resulted from the use of a developing solution containing a compound which dissolves silver halide therein, especially a developing solution containing sulfites in high concentration, are prevented from occurring.

BACKGROUND OF THE INVENTION

When a silver halide light-sensitive material is processed with a developing solution which contains a compound capable of dissolving silver halides, e.g., thiosulfates and sulfites, elution of a good deal of silver complexes from the silver halide light-sensitive material into the developing solution takes place. The silver complexes eluted into the developing solution are reduced with the developing agent and converted to fine metallic silver, resulting in the generation of silver sludge in the developing solution.

A developing solution which contains sulfite in a high concentration, especially in a concentration of about 0.1 mol/liter or more, has excellent quality in maintaining its developing activity upon storage. However, having once been used, the developing solution tends to be contaminated and to cause developing-stain on surfaces of light-sensitive materials developed. This phenomenon turns out to be a serious disadvantage, especially when high temperature development is carried out using an automatic developing processor. This is because when development-processing is carried out using an automatic developing processor not only is silver sludge suspended in the developing solution but also silver particles adhere to walls of the processing tank and to rollers of the developing processor, and so the light-sensitive materials are subject to contamination with silver deposited thereon in the form of roller streaks, the so-called "silver stain", which silver appears yellow or brown by reflecting light therefrom. Silver stain is generated on the surface of a light-sensitive material equally, regardless of the quantity of light to which the light-sensitive material is exposed, and forms a colored layer on the surface resulting in a marked deterioration of the image quality obtained. Thus, silver stain directly spoils the quality of the photographic image. Therefore, when photographic light-sensitive materials are processed with such a developing solution as described above using an automatic developing processor, the qualities of the finished photographs tend to be spoiled to a great extent.

As an inhibitor of silver sludge or liquid contamination, 2-mercapto-1,3,4-thiadiazoles (as described in British Patent 940,169), 2-mercapto-1,3,4-oxadiazoles or 1-phenyl-5-mercaptotetrazole (as described in U.S. Pat. No. 3,173,789), D,L-6,8-dithiooctanoic acid (as described in U.S. Pat. No. 3,318,701), o-mercaptobenzoic acid (as described in British Pat. No. 1,144,481), aliphatic mercaptocarboxylic acids (as described in U.S. Pat. No. 3,628,955), L-thiazolidine-4-carboxylic acid (as described in *J. Photogr. Sci.*, Vol. 13, page 233 (1965)), disulfide compounds [as described in Japanese Patent Application (OPI) No. 36029/77 (the term "OPI" as used herein refers to a "published unexamined Japanese patent application")], 2-benzoxazolethiol and 2-benzimidazolethiol (as described in *Photogr. Sci. Eng.*, Vol. 20, page 220 (1976)), and so on are known.

However, none of the above-described compounds, in a photographic developing solution which is capable of dissolving silver halide, especially in a developing solution containing sulfite in a high concentration, functions as a sludge inhibitor effectively enough to be completely satisfactory. For instance, aliphatic mercaptocarboxylic acid compounds are air oxidized, and consequently they tend to be oxidized by exposure to air and rapidly lose their sludge preventing effects; in addition, some of these compounds have unpleasant odors. The use of 1-phenyl-5-mercaptotetrazole or 2-benzoxazolethiol in a large amount can reduce liquid contamination in some cases; however, in other cases, these compounds react with silver ion to produce slightly soluble silver salts in the developing solutions, and thereby films are otherwise stained, rather than prevented silver stain. In addition, a large amount of such a compound in a developing solution disturbs the ability to achieve satisfactory photographic characteristics, since such compounds tend to inhibit development.

On the other hand, high temperature development, especially high temperature rapid processing using an automatic developing processor, is known as a process for carrying out development efficiently, and has proved fruitful upon the application to the processings of various kinds of light-sensitive materials. However, since light-sensitive materials are processed at high temperatures in this process, emulsion films subject to such processing must be prevented from becoming brittle at high temperatures so as to have sufficient mechanical strength to withstand the stress applied thereto by rollers and belts of the automatic developing processor. Therefore, it is necessary to devise a technique to increase the mechanical strength of an emulsion film as the development in a developing solution progresses and further, may be kept the mechanical strength during the processing.

For this purpose, the processing is carried out using a developing solution to which an aldehyde series hardener is added. According to this process, the total processing time can be shortened due to the processing at a high temperature, and the object of speeding up the processing can be attained. However, the development-processing with, e.g., developing solutions containing aldehydes, especially aliphatic dialdehydes, is attended by a significant generation of fog. The higher that the temperature of the developing solution is, and the longer the period of using the developing solution, the more significant is the tendency for the developing solution to cause fog. The occurrence of such fog resulting from aldehydes can be prevented by the use of a powerful fog restrainer, such as benzotriazole or 1-phenyl-5-mercaptotetrazole (which are described in L. F. A. Mason, *Photographic Processing Chemistry*, page 40, The Focal Press, 1966). However, the addition of such powerful fog restrainers to a developing solution retards the development to a great extent, and thereby the sensitivities of emulsions are reduced sharply.

5-Nitroindazole described in British Pat. No. 1,269,268 acts as an effective antifoggant in a developing solution containing an aldehyde series hardener. However, it has the disadvantages that an appropriate solvent is required because of its poor solubility in a developing solution, and its stability in a developing solution over a long period of time is low. Furthermore, satisfactory effect as a silver halide sludge inhibitor also is not exhibited.

SUMMARY OF THE INVENTION

Therefore, an object of this invention is to provide a process for development-processing a silver halide black-and-white light-sensitive material with a developing solution capable of dissolving silver halide, and especially a stable developing solution containing sulfite in a high concentration, using an automatic developing processor, in which process the developing solution is prevented from being contaminated with silver and the rollers and the belts of the automatic developing processor are also prevented from being stained with silver, and from which, therefore, photographic images free from silver stain and excellent in finished qualities are obtained.

Another object of this invention is to provide a process for development-processing, which process prevents the occurrence of silver sludge and silver stain in a developing solution for a silver halide black-and-white photographic light-sensitive material.

Still another object of this invention is to provide a process for development-processing, in which generation of fog resulting from the use of a developing solution containing an aldehyde series hardener is reduced, unaccompanied by sharp decreases in developing speed and emulsion sensitivity, and wherein the developing solution does not produce any insoluble matter, remains stable for long periods of time, and further does not generate silver sludge and silver stain.

A further object of this invention is to provide a process for development-processing in which the above-described objects are all attained and wherein compounds having good solubility in a developing solution are employed.

After conducting various investigations, it has now been found that the above-described objects are attained by a process for development-processing a silver halide light-sensitive material comprising processing with a developing solution containing sulfite ion in a concentration of 0.1 mol/liter or more and at least one compound represented by formula (I)

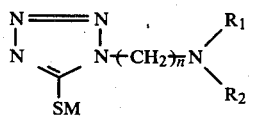

(I)

wherein n represents an integer of from 2 to 6; each of $R_1$ and $R_2$ (which may be the same or different) represents hydrogen or an alkyl group having from 1 to 6 carbon atoms; and M represents hydrogen or an alkali metal atom.

DETAILED DESCRIPTION OF THE INVENTION

In formula (I), which represents the compounds employable in this invention, the alkali metal atoms represented by M include sodium, potassium, and the like. The alkyl groups represented by $R_1$ and $R_2$ include a methyl group, an ethyl group, a propyl group, and the like.

Specific examples of such compounds are illustrated below. However, this invention is not intended to be construed as being limited to these examples.

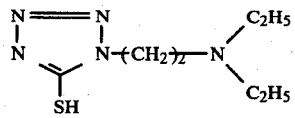

(I-1)

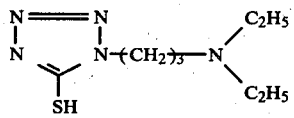

(I-2)

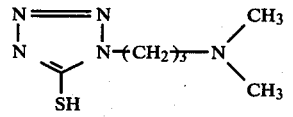

(I-3)

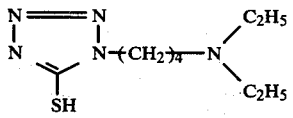

(I-4)

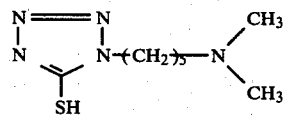

(I-5)

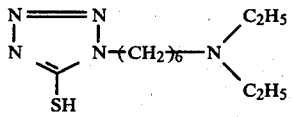

(I-6)

The compounds represented by the formula (I) according to the present invention can be easily synthesized by the following methods.

A synthesis method refers to reacting dithiocarbamic acids represented by the formula (II) with azidation agents.

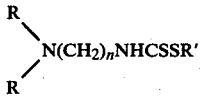

(II)

wherein R and R' each represents an alkyl group; and n represents an integer of 2 or 3.

Examples of such azidation agents include an alkali metal azide such as lithium azide, sodium azide, potassium azide, etc., and preferred example thereof is sodium azide.

The reaction described above is usually performed in the conventional organic solvents which do not interfere with such reaction, or water. Examples of such organic solvents include alcohols, aliphatic esters, ethers or ketones and preferred example thereof is alcohols. Furthermore, the reaction is usually performed at a temperature of from room temperature to 150° C. Preferred temperature is 50° C. to 120° C.

The objecting product prepared according to the reaction described above is neutralized with acids by the conventional method and then collected by conventional isolation methods. The isolation methods involve a method where an ion exchange resin, for example, a strongly acidic cation exchange resin, etc., is applied.

Another synthesis method refers to reducing a carbonyl group of compounds represented by the formula (III).

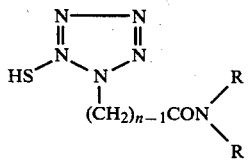

(III)

wherein R represents an alkyl group; and n represents an integer of 2 or 3.

Preferred examples of such reduction methods include catalytic reductions by means of catalysts, such as Raney nickel, platinum oxide, paradium-carbon, ruthenium-carbon, rhodium-carbon, copper-chromium oxide, etc.; methods by means of a metal such as sodium, sodium amalgam, aluminum amalgam, etc., together with water or alcohols; methods by means of an inorganic acid such as dilute hydrochloric acid solution, dilute sulfuric acid solution, dilute phosphoric acid solution, etc., together with a metal such as zinc, iron, tin, etc.; methods by means of an organic acid such as acetic acid, etc., together with a metal described above; methods by means of chemical reducing agents such as sodium dithionite, sodium boron hydride, sodium cyan boron hydride, aluminum lithium hydride, aluminum sodium hydride, aluminum diethyl hydride, etc. in neutral or weak acidic solution; or methods by means of diborane.

The reaction described above is usually performed in the conventional solvents. Examples of such solvents include water, alcohols, amides, ethers, halogenated hydrocarbons, etc. Furthermore, the reaction is usually performed at a temperature of from room temperature to elevated temperature.

The objecting product prepared according to the reaction described above is collected by conventional isolation.

These compounds can be synthesized by the methods described in Japanese Patent Application (OPI) Nos. 1475/76 and 50169/78.

Although the compounds represented by formula (I) according to the present invention are effective for the prevention of silver sludge and fog, compounds in which both $R_1$ and $R_2$ in formula (I) are ethyl groups exhibit particularly preferable effects.

The concentration of the compound represented by formula (I) in the developing solution ranges from about 0.005 g to 5 g, and preferably from about 0.01 g to 1.0 g, per liter of developing solution.

Developing solutions employable in the development processing of this invention are alkaline aqueous solutions containing conventionally used developing agents for black-and-white photography, alone or as a combination thereof. Specific examples of such developing agents include hydroquinone, alkylhydroquinones (e.g., t-butylhydroquinone, methylhydroquinone, dimethylhydroquinone, etc.), catechol, pyrazole, chlorohydroquinone, dichlorohydroquinone, alkoxyhydroquinones (e.g., methoxyhydroquinone and ethoxyhydroquinone), aminophenol series developing agents (e.g., N-methyl-p-aminophenol, 2,4-diaminophenol, etc.), ascorbic acid series developing agents, N-methyl-p-aminophenol sulfate, pyrazolones (e.g., 4-aminopyrazolone), 3-pyrazolidone series developing agents (e.g., 1-phenyl-3-pyrazolidone, 1-phenyl-4,4-dimethyl-3-pyrazolidone, 1-phenyl-5-methyl-3-pyrazolidone, 1-phenyl-4-methyl-3-pyrazolidone, 1,5-diphenyl-3-pyrazolidone, 1-p-tolyl-3-pyrazolidone, 1-phenyl-2-acetyl-4,4-dimethyl-3-pyrazolidone, 1-p-hydroxyphenyl-4,4-dimethyl-3-pyrazolidone, 1-(2-benzothiazolyl)-3-pyrazolidone and 3-acetoxy-1-phenyl-3-pyrazolidone), and so on.

In particular, combinations of hydroquinone and 3-pyrazolidones, or combinations of hydroquinone and aminophenols, are very useful for rapid processing at high temperature.

The developing solution containing the compound represented by formula (I) used in the present invention exhibit the silver sludge preventing effect remarkably, particularly when the developing solution contains a large amount of sulfite ions. In such the developing solution contains sulfite ion in a concentration of specifically 0.1 mol or more, and preferably 0.2 mol to 1.0 mol, per liter of developing solution. As the sulfites which provide sulfite ions, an alkali metal sulfite such as sodium sulfite, potassium sulfite, potassium metabisulfite and so on are preferably used. The bisulfite salts also provide sulfite ions.

Silver sludge generated in the developing solution tends to be deposited particularly on the rollers and belts of a developing processor and to adhere thereto, and the silver sludge attached to the rollers and the belts tends to stain light-sensitive materials. Therefore, the process of this invention is particularly effective for processing utilizing an automatic developing processor.

Examples of such an automatic developing processor include those using an opposed roll arrangement system (e.g., Pakorol Super G24-2 produced by PAKO Co., Ltd., G-14L, FG-24SQ and RN, produced by Fuji Photo Film Co., Ltd., etc.), those using a zig-zag roll arrangement system (e.g., Kodalith Processor and M6 Processor, produced by Eastman Kodak Co., RU produced by Fuji Photo Film Co., Ltd., etc.), those using a belt conveyor system (e.g., LD-241D produced by Log-E-tronics Co., Ltd., etc.), and other systems (e.g., Cronalith 24L produced by E. I. Du Pont de Nemours, Co., etc.).

Moreover, bad fog resulting from processing with a developing solution which containing significant amounts of sulfite ion and further an aldehyde series hardening agent, especially an aliphatic dialdehyde, can be prevented from occurring by the addition of the compound according to this invention, without a sharp reduction in developing speed. Simultaneously with the prevention of such bad fog, silver sludge is also almost completely prevented. Therein, such a hardening agent may be present in an amount of from 1 to 20 g per liter of developing solution.

Examples of the aldehyde series hardening agents include compounds having at least one aldehyde group, the sulfites thereof, and the hydrogensulfite adduct thereof. More specifically, formaldehyde, dimethylol urea, glyoxal, glutaraldehyde and the like can be employed.

In addition to the above-described agents, the developing solution may optionally contain a buffer (e.g., carbonates, boric acid, borates, and alkanolamines), an alkali agent (e.g., hydroxides and carbonates), a dissolving aid (e.g., polyethylene glycols and esters thereof), a pH adjusting agent (e.g., an organic acid such as acetic acid), a sensitizer (e.g., quaternary ammonium salts), a development accelerator, a surface active agent, and so on.

An antifogging agent (e.g., 5-nitroindazole, 5-nitrobenzimidazole, benzotriazoles such as 5-methylbenzotriazole, 5-nitrobenzotriazole, etc., thiazoles such as benzothiazole, tetrazoles such as 1-phenyl-5-mercaptotetrazole, the compounds described in British Pat. No. 1,269,268, and so on), and a chelating agent (e.g., ethylenediaminetetraacetic acid, alkali metal salts thereof, polyphosphates, and nitriloacetates) can be further incorporated into the developing solution.

The pH of the thus-prepared developing solution is selected within a pH range that the desired density and contrast may be achieved in the image developed therein, and it is generally desirable for the pH to range from about 8 to 12, and more preferably from about 9.0 to 10.5.

The development-processing temperature and development-processing time depend upon each other and they are determined depending upon the total processing time. Accordingly, the development-processing is generally carried out at a temperature of from about 20° C. to 50° C. for a period of from 10 seconds to 3 minutes. For high temperature rapid processing, a processing temperature of about 30° C. to 60° C. is employed.

In this invention, a developing solution serves the intended purpose if only a complete set of the essential components are present at the time of use. Therefore, when a developing solution is prepared before processing, various components as described above for the developing solution may be employed, in various forms, e.g., solid mixture, concentrate, solution, emulsion, suspension, and so on. For example, ingredients to be used for preparing the developing solution may be separated into groups, and such groups may be kept separately prior to combining for the intended use. On the other hand, the ingredients may be in the form of a concentrated, previously prepared, powdery or liquid mixture.

At the time of its use, the prepared developer is optionally dissolved in water or diluted with water, and then used.

On the other hand, a fixing solution is, as described above, a water solution containing a thiosulfate and a water-soluble aluminum compound, which is adjusted desirably to a pH of about 3.8 to 5.0 (at 20° C.). In the process of this invention although a stopping step can be provided after the developing step, the stopping step is generally omitted in a roll conveyor type automatic developing processor. Consequently, the developing solution is carried into the fixing solution, and the pH of the fixing solution increases. Therefore, it is desirable to adjust the pH of the fixing solution to about 3.8 to 4.6 (at 20° C.) in advance.

Thiosulfates such as ammonium thiosulfate, sodium thiosulfate, and the like are employed, as a fixing agent and ammonium thiosulfate is particularly preferred in terms of fixing speed. The amount of a fixing agent used can be changed appropriately depending on circumstances, but it generally ranges from about 0.1 to 5 mol/liter.

Water-soluble aluminum salts which function principally as a hardening agent in a fixing solution are compounds known generally as a hardening agent for acid hardening fixing solutions, and they include, e.g., aluminum chloride, aluminum sulfate, potassium alum, and the like.

In accordance with the process of this invention, photographic materials developed and fixed are washed with water, and then dried. The washing is carried out in order to remove almost completely silver salts dissolved in the fixing step, and it is desirable for the washing to be continued for from 10 seconds to 3 minutes at a temperature of from about 5° C. to 50° C. The drying is carried out at a temperature of about 40° C. to 100° C., and the drying time is changed appropriately depending upon the circumstances. However, the drying time may usually range from about 5 seconds to 3 minutes and 30 seconds.

Any type of light-sensitive materials can be processed using the process of this invention. However, it is especially useful to apply this process to black-and-white light-sensitive materials, that is, X-ray light-sensitive material, light-sensitive materials for microfilms, light-sensitive materials for anlith, light-sensitive materials for photo-composition, black-and-white light-sensitive materials for amateur photography, and so on.

Silver halides of the light-sensitive layers may be silver chloride, silver chlorobromide, silver chloroiodobromide, silver bromide, silver iodobromide or so on. In addition, both negative type and direct positive type light-sensitive materials may be used in this invention.

The silver halide photosensitive materials applicable to the process of this invention comprise a support and at least one silver halide emulsion layer provided on the support. Not only can one side of the support be coated with a silver halide emulsion layer, but also the other side thereof may be coated with a silver halide emulsion layer. Of course, the light-sensitive material can optionally have a backing layer, an antihalation layer, an interlayer, a topmost layer (e.g., a protecting layer) and so on. The silver halide emulsions are dispersions of silver halide in hydrophilic colloids (e.g., gelatin, denatured gelatin, colloidal albumin, casein, carboxymethyl cellulose, hydroxyethyl cellulose, sodium alginate, polyvinyl alcohol, polyvinyl pyrrolidone or mixtures thereof). The silver halide emulsions are prepared by mixing water-soluble silver salts (e.g., silver nitrate) and water-soluble halides in the presence of water and hydrophilic colloids using conventional methods well known in this art (e.g., the single jet method, the double jet method, the controlled double jet method and so on) and then subjecting the resulting emulsion to both a physical ripening treatment and a chemical ripening treatment (e.g., gold sensitization and/or sulfur sensitization, and so on). Spectral sensitizers (e.g., cyanine dyes, merocyanine dyes or mixture thereof), stabilizers (e.g., 4-hydroxy-6-methyl-1,3,3a,7-tetraazaindene), sensitizers (e.g., compounds as described in U.S. Pat. No. 3,619,198), antifoggants (e.g., benzotriazole, 5-nitrobenzimidazole, polyethylene oxide, or compounds as described in Japanese Patent Application No. 79979/71), hardeners (e.g., formaldehyde, glyoxal, mucochloric acid, and 2-hydroxy-4,6-dichloro-s-triazine), coating aids (e.g., saponin, sodium laurylsulfate, dodecylphenol polyethylene oxide ether, and hexadecyltrimethylammonium bromide), and so on can be added to the silver halide emulsions, during preparation or just before coating. The thus-prepared silver halide emulsion is coated on a support, such as a baryta paper, a resin coated paper, a cellulose acetate film, a polyethylene terephthalate film or so on, using the dip coating technique, the air knife coating technique, the bead technique, the extrusion doctor technique, the double coating technique or so on, and then dried.

The present invention is illustrated in greater detail by reference to the following examples. However, the invention is not intended to be construed as being limited to these examples. Unless otherwise indicated herein, all parts, percents, ratios and the like are by weight.

EXAMPLE 1

Developing Solutions (A), (B), and (C), having the following compositions, were prepared.

Developing Solution (A)

| | |
|---|---|
| Sodium Sulfite | 67 g |
| Hydroquinone | 23 g |
| 1-Phenyl-3-pyrazolidone | 0.4 g |
| Potassium Hydroxide | 11 g |
| Sodium Carbonate (monohydrate) | 11 g |
| Potassium Bromide | 3.0 g |
| Water to make | 1 l |
| pH | 10.65 |

Developing Solution (B)

To Developing Solution (A) was added 300 mg of Compound (I-1). The pH was 10.65.

Developing Solution (C)

To Developing Solution (A) was added 300 mg of Compound (I-3). The pH was 10.65.

The fixing solution used had the following composition.

Composition of Fixing Solution

| | |
|---|---|
| Ammonium Thiosulfate | 200.0 g |
| Sodium Sulfite (anhydrous) | 20.0 g |
| Boric Acid | 8.0 g |
| Disodium Ethylenediaminetetraacetate | 0.1 g |
| Aluminum Sulfate | 15.0 g |
| Sulfuric Acid | 2.0 g |
| Glacial Acetic Acid | 22.0 g |
| Water to make | 1.0 l |
| pH adjusted to | 4.2 |

Using each of these Developing Solutions (A), (B), and (C), the following processings were carried out.

A 22 liter portion of each of the developing solutions was placed in a roll conveyor automatic developing processor (FG-24SQ, produced by Fuji Photo Film Co., Ltd.). A black-and-white photographic film having a silver chlorobromide (silver chloride: 50 mol%) emulsion layer (silver content: 4 g/m$^2$) on a polyethylene terephthalate film was passed into the above-described developing processor after imagewise exposure, and was development-processed therein. The development-processing was carried out under the condition of a developing temperature of 38° C., a developing time of 20 seconds, and the developing solution was automatically supplemented with a 100 ml portion of replenisher for each development-processing of one film of great whole paper size (i.e., 20 inch×24 inch). One hundred films of great whole paper size were development-processed over a period of 5 hours per day, and such an operation was continued for one week. In the case of the Developing Solution (A), where no compounds according to formula (I) of this invention were present, the developing solution, which was originally colorless and transparent, began to become turbid at an early stage of the operation, and deposition of silver sludge was observed during the first one hundred films' development-processing.

Under such conditions, striped silver stain began to appear on the films developed, and such stain became more and more serious as the development-processing was continued over a period of one week. A thick turbidity and deposition of silver sludge were observed in the developing solution, and on the rolls of the automatic developing processor considerable silver stain was present. In addition, striped silver stain on the film developed increased with the number of films passed through the development-processing using the same developing solution.

Further, abrasion, which appeared to be caused by contact with sludge adhered to the rolls, was observed on the surfaces of films.

On the other hand, Developing Solutions (B) and (C) which contained therein Compounds (I-1) and (I-3) of this invention which were originally colorless and transparent, were entirely transparent even after one week's development-processing. Moreover, silver sludge was not noticed and silver stain and abrasion were not observed at all on any surface of film developed.

EXAMPLE 2

"RX" X-ray films (trademark of Fuji Photo) which had received stepwise exposure using an optical wedge were subjected to high temperature rapid development-processing which included the following steps, in the order listed, wherein the following six developing solutions were employed, respectively.

| Processing Step | Temperature | Time |
|---|---|---|
| 1. Development | 35° C. | 25 sec |
| 2. Fixing | 35° C. | 25 sec |
| 3. Washing | 20° C. | 30 sec |

Developing Solution (A)

| | |
|---|---|
| 1-Phenyl-3-pyrazolidone | 1.5 g |
| Hydroquinone | 30 g |
| Sodium Sulfite (anhydrous) | 50 g |
| Potassium Hydroxide | 20 g |
| Boric Acid | 10 g |
| Glutaraldehyde (25% aq. soln.) | 20 ml |
| Water to make | 1 l |
| pH adjusted to | 10.20 |

Developing Solution (B)

To Developing Solution (A) was added 100 mg of Compound (I-1).

Developing Solution (C)

To Developing Solution (A) was added 100 mg of Compound (I-3).

Developing Solution (D)

To Developing Solution (A) was added 100 mg of 5-nitroindazole as described in British Pat. No. 1,269,268.

Developing Solution (E)

To Developing Solution (A) was added 100 mg of 1-phenyl-5-mercaptotetrazole.

Developing Solution (F)

To Developing Solution (A) was added 100 mg of 1-(3-caproacids)phenyl-5-mercaptotetrazole as described in British Pat. No. 1,119,799.

The pH of these Developing Solutions (B) to (F) was 10.20.

The composition of fixing solution used is described below:

| | |
|---|---|
| Ammonium Thiosulfate | 200.0 g |
| Sodium Sulfite (anhydrous) | 20.0 g |
| Boric Acid | 8.0 g |
| Disodium Ethylenediaminetetraacetate | 0.1 g |
| Aluminum Sulfate | 15.0 g |
| Sulfuric Acid | 2.0 g |
| Glacial Acetic Acid | 22.0 g |
| Water to make | 1.0 l |
| pH adjusted to | 4.20 |

The photographic characteristics obtained are summarized in Table 1 below.

TABLE 1

| Developing Solution | Fog | Relative Sensitivity (Fog + 1.0) | Gamma | Maximum Density |
|---|---|---|---|---|
| A | 1.25 | 100 | 1.00 | 2.90 |
| B | 0.16 | 80 | 2.90 | 3.20 |
| C | 0.16 | 80 | 2.90 | 3.20 |
| D | 0.16 | 65 | 2.60 | 3.00 |
| E | 0.14 | 10 | <1 | 2.00 |
| F | 1.00 | 100 | 1.30 | 2.90 |

Each of gamma values in Table 1 was determined from one intersection of their respective characteristic curve and a density line having a value of fog density plus 0.25, and another intersection of the characteristic curve and a different density line which had a value of the above-described density line value plus 1.75. In Developing Solutions (B) and (C) wherein the compounds of this invention were employed, fog was effectively prevented from occurring due to the presence of aldehydes without a sharp decrease in sensitivity, and gamma values could be greatly increased, compared with Developing Solution (A) where no compound of this invention was employed. Developing Solution (E), where 1-phenyl-5-mercaptotetrazole was employed, had an antifogging effect, but sharply decreased the relative sensitivity. Therefore, Developing Solution (E) was not suitable for practical use.

Developing Solution (F), where 1-(3-caproacid)phenyl-5-mercaptotetrazole was employed, has substantially no fog preventing effect, and thus was not suitable for practical use.

Compared with Developing Solution (D), where 5-nitroindazole described in British Pat. No. 1,269,268 was employed, Developing Solutions (B) and (C) wherein the compounds of the present invention were employed caused generation of fog with nearly equal densities, but advantageous results regarding photographic characteristics were achieved in that the relative sensitivities, the gamma values and the maximum densities could be enhanced by about 20%, from 0.15 to 0.30, and from 0.1 to 0.20, respectively. Moreover, although 5-nitroindazole has a poor solubility in the developing solution and requires special solvents such as glycols, and furthermore has a low stability in the developing solution, the compounds of this invention have good solubilities in the developing solution, and consequently do not require any special solvent for dissolution into the developing solution and they have excellent stability in the developing solution.

Furthermore, the hardening activity in the silver halide layer was not decreased by using the compounds according to the present invention.

EXAMPLE 3

Each of Developing Solutions (A) to (E) were again prepared and then separated into two portions just after preparation. One portion was immediately used for development-processing as described below, while the other portion was used after storage in a sealed container made of polyethylene, in which 20% by volume of air based on a volume of the container was enclosed for a period of one week at a temperature of 40° C.

Each of the thus-prepared, fresh and stored Developing Solutions (A) to (E) was placed in a quantity of two liters in a roll conveyer type Fuji X-ray processor RE automatic developing processor (produced by Fuji Photo Film Co., Ltd.). "RX" X-ray films (trademark of Fuji Photo) were development-processed in the above-described RE automatic developing processor after exposure. The development-processing was carried out under conditions of a developing temperature of 35° C., a developing time of 25 seconds per sheet of film, and the developing solution was automatically supplemented with a 25 ml portion of developing solution for each development-processing of one sheet of film having a size of 30.5 cm×25.4 cm. After one hundred sheet-form films were development-processed over a period of five hours, the results as summarized in Table 2 below were obtained.

TABLE 2

| Developing Solution | Developing Solution just after Preparation | Developing Solution after Storage at 40° C. for One Week |
|---|---|---|
| (A) | The solution became considerably turbid and silver sludge was deposited after 1 day. | The solution became considerably turbid and sludge deposited increased in quantity. |
| (B) | The solution remained colorless and transparent, and sludge was not observed. | The solution remained colorless and transparent and sludge was not observed. |
| (C) | The solution remained colorless and transparent, and sludge was not observed. | The solution remained colorless and transparent and sludge was not observed. |
| (D) | The solution became slightly turbid, and sludge was deposited after 1 day. | The solution became considerably turbid, and sludge deposited increased in quantity. |
| (E) | The solution became turbid, and sludge was deposited after 1 day. | The solution became considerably turbid, and sludge deposited increased in quantity. |

As is apparent from the results shown in Table 2 above, Developing Solutions (B) and (C), in which the compounds of this invention were employed, were highly effective for prevention of silver sludge, and their effects remained unchanged even after storage for one week at 40° C.

Among the fresh solutions, Developing Solutions (B) and (C) exhibited much stronger silver sludge preventing ability than Developing Solution (D).

On the other hand, Developing Solutions (D) and (E) in which 5-nitroindazole and 1-phenyl-5-mercaptotetrazole were employed, respectively, did not have satisfactory effects in prevention of silver sludge.

While the invention has been described in detail and with reference to specific embodiments thereof, it will be apparent to one skilled in the art that various changes and modifications can be made therein without departing from the spirit and scope thereof.

What is claimed is:

1. A process for development-processing an imagewise exposed silver halide photographic light-sensitive material comprising processing the material with a developing solution containing 0.1 mol/liter or more of sulfite ion and at least one compound represented by formula (I)

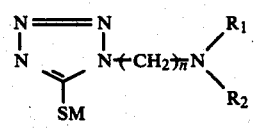

(I)

wherein n represents an integer of from 2 to 6; each of $R_1$ and $R_2$ represents an alkyl group having from 1 to 6 carbon atoms; and M represents hydrogen or an alkali metal atom.

2. A process for development-processing as in claim 1, wherein the alkyl group represented by $R_1$ or $R_2$ is a methyl group, an ethyl group, or a propyl group.

3. A process for development-processing as in claim 1, wherein each of $R_1$ and $R_2$ represents an ethyl group.

4. A process for development-processing as in claim 1, 2, or 3, wherein the concentration of the compound represented by formula (I) is from 0.005 g to 5 g per liter of developing solution.

5. A process for development-processing as in claim 1, 2, or 3, wherein the concentration of the compound represented by formula (I) is from 0.01 g to 1.0 g per liter of developing solution.

6. A process for development-processing as in claim 4, wherein the concentration of the sulfite ion is from 0.2 mol to 1.0 mol per liter of developing solution.

7. A process for development-processing as in claim 1, wherein the developing solution contains an aldehyde hardener.

8. A process for development-processing as in claim 7, wherein the aldehyde hardener is a compound containing at least one aldehyde group, the sulfite adduct thereof or the hydrogensulfite adduct thereof.

9. A process for development-processing as in claim 7, wherein the aldehyde hardener is formaldehyde, dimethylolurea, glyoxal, or glutaraldehyde.

10. A process for development-processing as in claim 7, wherein the concentration of the aldehyde hardener is from 1 g to 20 g per liter of developing solution.

11. A process for development-processing as in claim 1, wherein the development-processing is carried out using an automatic developing processor.

12. A process for development-processing as in claim 1, wherein the pH of the developing solution ranges from 8 to 12.

13. A process for development-processing as in claim 1, wherein the pH of the developing solution ranges from 9.0 to 10.5.

14. A process for development-processing as in claim 1, wherein the temperature of the developing solution ranges from 20° C. to 50° C.

15. A process for development-processing as in claim 1, wherein the temperature of the developing solution ranges from 30° C. to 60° C.

16. A process for development-processing as in claim 1, wherein the developing solution is an aqueous alkaline solution containing a developing agent for black-and-white photography.

17. A process for development-processing as in claim 16, wherein the developing agent is hydroquinone, an alkylhydroquinone, catechol, pyrazole, chlorohydroquinone, dichlorohydroquinone, an alkoxy hydroquinone, an aminophenol, an ascorbic acid, a pyrazolone, or a 3-pyrazolidone.

18. A process for development-processing as in claim 16, wherein the developing agent is a combination of hydroquinone and a 3-pyrazolidone.

19. A process for development-processing as in claim 16, wherein the developing agent is a combination of hydroquinone and an aminophenol.

* * * * *